US010745946B2

(12) United States Patent
Scholz et al.

(10) Patent No.: US 10,745,946 B2
(45) Date of Patent: Aug. 18, 2020

(54) CLOSING DEVICE HAVING A CONTROL DISK AND METHOD FOR CLOSING A HOOD BY MEANS OF SUCH A CLOSING DEVICE

(71) Applicant: Kiekert AG, Heiligenhaus (DE)

(72) Inventors: Michael Scholz, Essen (DE); Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 793 days.

(21) Appl. No.: 15/323,189

(22) PCT Filed: Jun. 16, 2015

(86) PCT No.: PCT/DE2015/100241
§ 371 (c)(1),
(2) Date: Feb. 22, 2017

(87) PCT Pub. No.: WO2016/000682
PCT Pub. Date: Jan. 7, 2016

(65) Prior Publication Data

US 2017/0191291 A1 Jul. 6, 2017

(30) Foreign Application Priority Data

Jun. 30, 2014 (DE) ..... 10 2014 109 111

(51) Int. Cl.
*E05B 83/24* (2014.01)
*E05B 81/20* (2014.01)
(Continued)

(52) U.S. Cl.
CPC ..... *E05B 81/20* (2013.01); *E05B 81/14* (2013.01); *E05B 81/16* (2013.01); *E05B 81/34* (2013.01);
(Continued)

(58) Field of Classification Search
CPC ..... Y10S 292/14; E05B 83/24; E05B 81/16; E05B 81/20; E05B 81/34; Y10T 292/1082
See application file for complete search history.

(56) References Cited

U.S. PATENT DOCUMENTS 4,395,064 A * 7/1983 Bellot ..... E05B 81/20 292/201
5,150,933 A * 9/1992 Myslicki ..... E05B 83/16 292/216
(Continued)

FOREIGN PATENT DOCUMENTS

DE 1801154 A1 * 4/1970 ..... E05B 83/16
DE 197 00 887 A1 7/1998
(Continued)

OTHER PUBLICATIONS

International Search Report and Written Opinion for corresponding Patent Application No. PCT/DE2015/100241 dated Oct. 30, 2015.

*Primary Examiner* — Carlos Lugo
(74) *Attorney, Agent, or Firm* — Renner, Otto, Boisselle & Sklar, LLP

(57) ABSTRACT

A closing device includes a locking mechanism having a rotary latch and at least one pawl for locking the rotary latch and an electric drive. The closing device is advantageous for front hoods or front flaps, which are located in the front as viewed in the typical direction of travel of a motor vehicle. A method for closing a hood includes using the closing device. The closing device enables a purely electrically operated hood lock having locking, opening, and closing functions. The closing device includes a locking mechanism having a control disk, in which at least two components of the closing device can be moved by rotation of the control disk. Thus, for suitable movement of a plurality of components, it is only necessary to rotate the control disk by
(Continued)

Figure 1:
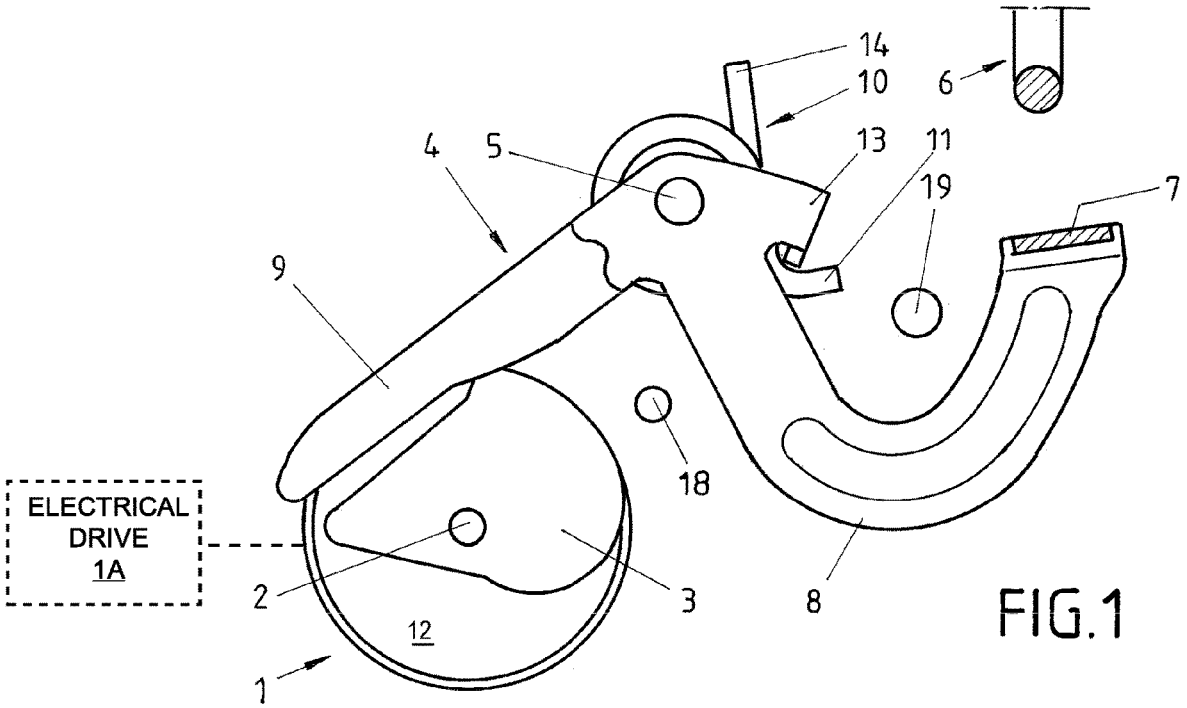

rotation by an electric drive to be able to close and/or open a door or flap.

9 Claims, 2 Drawing Sheets

(51) Int. Cl.

| | |
|---|---|
| ***E05B 81/34*** | (2014.01) |
| ***E05B 81/14*** | (2014.01) |
| ***E05B 81/42*** | (2014.01) |
| ***E05B 81/16*** | (2014.01) |
| *E05B 81/06* | (2014.01) |

(52) U.S. Cl.
CPC ..... *E05B 81/42* (2013.01); *E05B 83/24* (2013.01); *E05B 81/06* (2013.01); *Y10S 292/14* (2013.01); *Y10T 292/1082* (2015.04)

(56) References Cited

U.S. PATENT DOCUMENTS

| | | | | | |
|---|---|---|---|---|---|
| 6,079,237 | A * | 6/2000 | Hochart | ..... | E05B 81/14 292/201 |
| 6,082,158 | A | 7/2000 | Wegner | | |
| 6,557,910 | B2 * | 5/2003 | Amano | ..... | E05B 81/14 292/201 |
| 6,666,483 | B2 * | 12/2003 | Baniak | ..... | E05B 83/24 292/123 |
| 8,646,816 | B2 * | 2/2014 | Dziurdzia | ..... | E05B 17/0029 292/201 |

FOREIGN PATENT DOCUMENTS

| | | | | | |
|---|---|---|---|---|---|
| DE | 197 39 340 | A1 | 3/1999 | | |
| DE | 198 41 670 | A1 | 3/2000 | | |
| DE | 10019668 | A1 * | 10/2001 | ..... | E05B 81/14 |
| DE | 102007060915 | | 6/2007 | | |
| DE | 202006012091 | | 12/2007 | | |
| DE | 202007005992 | | 8/2008 | | |
| DE | 10 2008 008175 | A1 | 8/2009 | | |
| DE | 202008014183 | | 3/2010 | | |
| DE | 102013109051 | | 2/2015 | | |
| DE | 102014118635 | A1 * | 4/2016 | ..... | E05B 81/06 |
| EP | 0 960 994 | A2 | 12/1999 | | |
| EP | 1 489 252 | A2 | 12/2004 | | |
| EP | 1 518 982 | A2 | 3/2005 | | |
| FR | 2768761 | A1 * | 3/1999 | ..... | E05B 81/66 |
| WO | WO-2011052540 | A1 * | 5/2011 | ..... | E05B 81/14 |

* cited by examiner

CLOSING DEVICE HAVING A CONTROL DISK AND METHOD FOR CLOSING A HOOD BY MEANS OF SUCH A CLOSING DEVICE

The invention relates to a latching device with a locking mechanism comprising a catch and at least a pawl for latching of the catch. The latching device encompasses an electrical drive for movement of the components of the latching device. The present invention is especially advantageous for front hoods or front flaps which are located at the front when viewed in the usual direction of travel of a motor vehicle.

Furthermore, the invention relates to a procedure for latching of a hood.

The purpose of a latching device is for the temporary latching of openings in motor vehicles or buildings with the aid of doors or flaps. In the closed state, the catch with two arms grasps around an especially bracket-shaped locking bolt, also known as a latch holder, and is latched by a pawl. The locking bolt can then not leave the locking mechanism. The pawl must be moved out of its latched position for opening. The catch can then pivot in the direction of the opening position in order to thus release the locking bolt or latch holder and enable opening of the door or the flap. In the case of a motor vehicle, the locking bolt can be attached to a door or a flap of the motor vehicle and then the latch to the chassis or vice versa.

Latching devices demonstrate an increasing number of levers which need to be pivoted in order to close a door or flap in a scheduled manner. It has recently been striven towards minimizing a gap between a door or a flap and the adjacent chassis in order to prevent disadvantageous air turbulence, for example. Compared to classic latching devices, this requires additional components which need to be moved for latching.

The German patent registration DE 10 2013 109 051 involves minimization of gaps or joints on doors or flaps. The latch known from this is movable and in particular pivotably located. Following latching of the locking mechanism, the latch is moved or pivoted overall by a drive in such a way that a gap between the door or flap and chassis is minimized. The drive provided for this purpose comprises an electromotor and a pivotable lever which is known as a swing arm. By pivoting of the lever or the swing arm by the electromotor, the latch as a whole is pivoted in such a way that the gap is minimized. The latch housing is retained by a pawl which is rotatably attached to the swing arm. The latching device known from this publication DE 10 2013 109 051 thus encompasses a drive of the sense stated at the start, with which the latch overall and thus also the locking mechanism can be moved in such a way that a door gap or flap gap can be decreased following closure of a door or a flap.

Hood or flap latches arranged in the front region of a vehicle must fulfill particular safety requirements. e.g. two independent latching systems (latch and arresting hook), but at least two activations should be present to open the flap/hood.

Customary systems open a latch from the inside and externally can be opened by the gap arising between the hood and the chassis of the arresting/safety hook. Inconvenient operation and dirty fingers are the rule. Newer systems enable opening from the inside due to dual complete pulling and releasing.

The disadvantage of these systems is the high opening forces (pre-tensioning due to strong springs, sealing forces) and loud latching noises as the hood needs to fall from a height of at least 20 cm in order to reliably fall into the latch.

Purely electrical systems are convenient, but can cause great damage due to control errors (e.g. unwanted opening). Particularly expensive electronic systems are necessary in order to prevent this. An emergency opening concept is also necessary by means of an emergency electricity supply in the absence of mechanical redundancy.

Combined systems such as opening, e.g. it must be conveniently electrically operated both internally and externally (arresting hook).

The various stated systems regularly require a high number of components which need to be moved.

The present invention strives towards being able to suitably move and control the majority of components on a latching device of the type stated at the start without causing excessive technical effort. The invention should preferably enable a purely electrically operated hood latch with a latching, opening and closure function.

The task of the invention is solved by the object with the characteristics of claim 1 and a procedure with the characteristics of the sub-claim. Advantageous designs arise from the sub claims. Unless stated otherwise hereinafter, the object of the invention can be combined at will with one or several of the characteristics stated at the start.

In order to solve the task, a latching device with a locking mechanism encompasses a control disk, with which at least two components, preferably at least three components of the latching device can be moved by rotating the control disk. Thus, for suitable movement of a majority of components it is only necessary to rotate the control disk by rotation using an electrical drive to be able to close and/or open a door or a flap.

The control disk preferably demonstrates a multitude of control curves or control contours for movement of components such as the pawl, transmission lever or ejector lever, which are preferably located in different planes. The advantage of this construction is that only one plane with a further control contour needs to be added if a further component should be moved by the control disk. Furthermore, it is not necessary to change the construction of the control disk or the position of its drive. Also, generally, the arrangement of the components already present which are moved by the control disk do not need to be changed if the components are arranged in different planes.

A hood can be lifted and/or lowered with an ejector lever for the purpose of the present invention. A transmission lever can decrease a gap between a door or a flap and an adjacent chassis, in particular after the locking mechanism has been ratcheted. If the control disk can move the components pawl, transmission lever or ejector lever, a purely electrically operated hood latch can be retained with a locking, opening and closure function.

Hereinafter, an execution example of the invention is explained in further detail on the basis of the figures. Characteristics of the execution example can be individually or severally combined with the stressed object.

Figure 2:
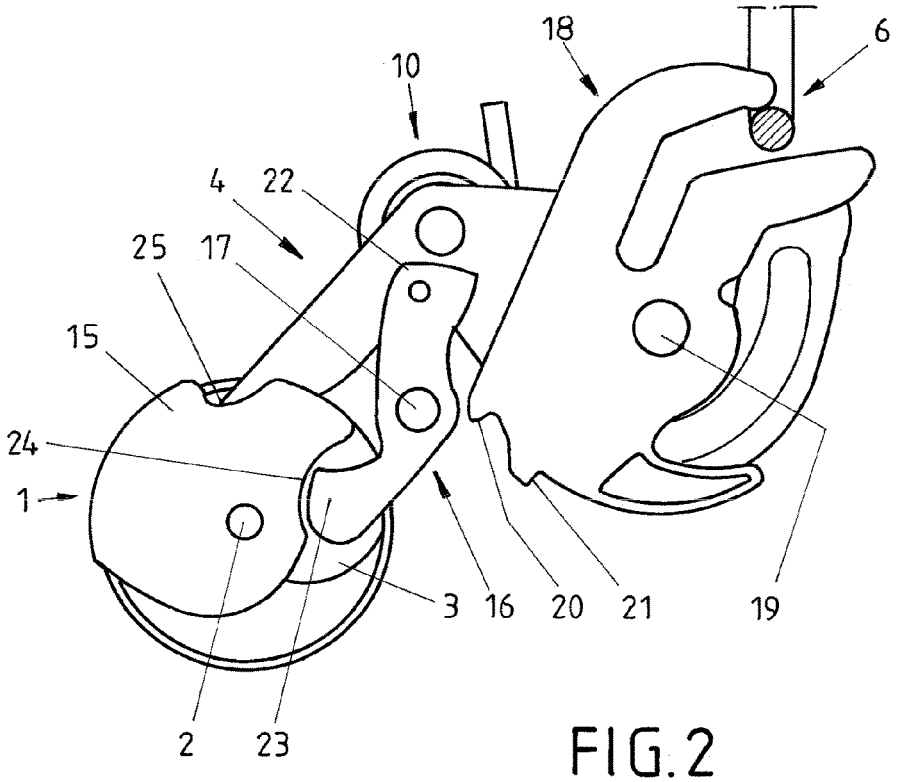
Figure 3:
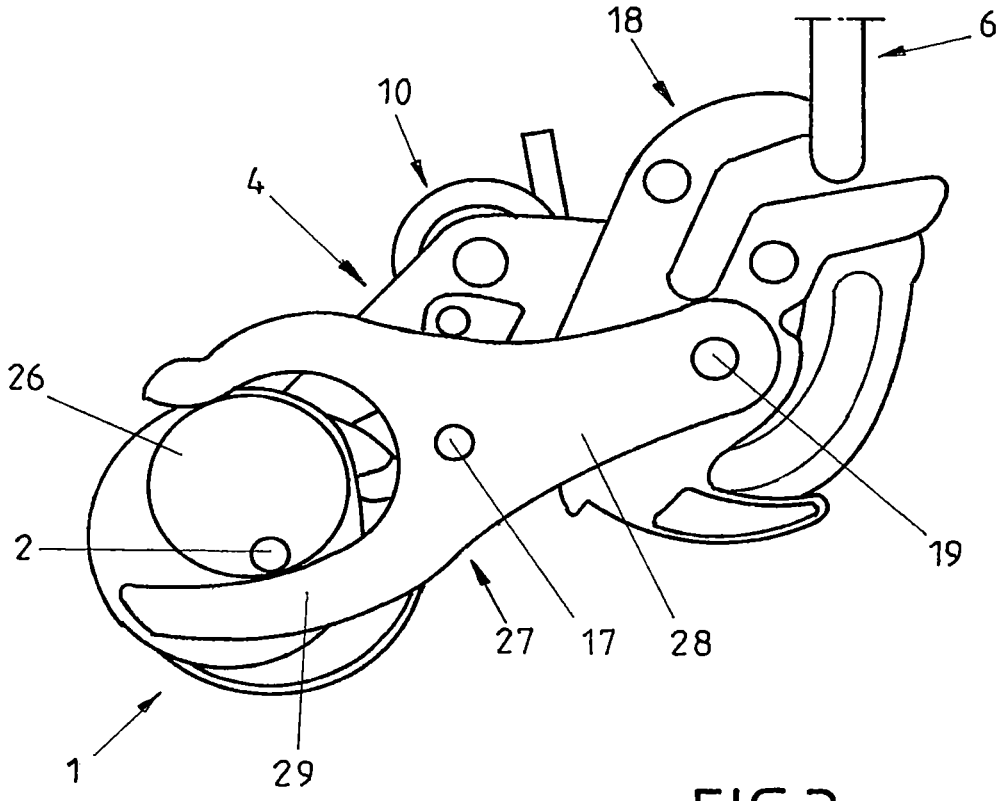

The following are shown:

FIG. 1: first control contour with ejector lever;

FIG. 2: second control lever with locking mechanism;

FIG. 3: third control contour with transmission lever,

FIG. 1 depicts a first plane of the control disk 1 in addition to a pertaining movable component. The control disk 1 can be pivoted around its axis 2 by an electrical drive 1A. An approximately triangular-shaped control contour 3 for pivoting of an ejector lever 4 is located in a first plane above a gearwheel 12. The control contour 3 is also bracket-shaped in the region adjacent to the peripheral area of the gearwheel 12 in order to thus maintain the ejector lever 4 in a lowered position and to be able to rotate the control disk 1 nevertheless in order to move other components in a controlled manner. The ejector lever 4 can be pivoted around an axis 5. If the pertaining hood is closed, the latch holder or locking bolt 6 of the hood is ultimately supported on the free end 7 of one lever arm 8 of the ejector lever 4. If the latch holder 6 is supported on the free end 7, the hood can be lifted or lowered by pivoting of the ejector lever 5 as follows: If the control disk 1 is rotated in an anti-clockwise direction, the control contour 3 pivots the other lever arm 9 of the ejector lever 4 in a clockwise direction around the axis 5. Hereby, the free end 7 of the lever arm 8 is lowered and thus the supporting latch holder 6 alongside the non-illustrated hood. If the control disk 1 is rotated in a clockwise direction, the ejector lever 4 is pivoted in an anti-clockwise direction due to the spring force of a spring 10. The latch holder 6 supporting on the free end 7 is lifted hereby and thus also the pertaining hood. The spring 10 possesses a leg 11 which is adjacent in a pre-tensioned manner to a short lever arm 13 of the ejector lever 4 in order to thus be able to pivot the ejector lever 4 in an anti-clockwise direction. The other leg 14 of the spring 10 is accordingly adjacent in a pre-tensioned manner on a non-illustrated bracket or wall. The free end of the lever arm 13 is preferably bent off in order to hold the adjacent spring leg with particular reliability.

The arm 9 of the ejector lever 4 is preferably extended and in a straight line in order to suitably move the ejector lever. The arm 8 of the ejector lever 4 preferably runs in a bracket-shaped manner around the inlet area for the latch holder 6 as shown in the figure in order on the one hand not to prevent latching and on the other hand to be able to provide a support for the latch holder 6. Such a support is preferably provided by a bent off flap 7 in order to create an adequately large surface and to thus guarantee reliable functioning.

FIG. 2 shows a second plane above the gearwheel 12 with a control contour 15 for control or movement of a pawl 16. The pawl 16 is pivotably located by an axis 17. The pawl 16 can latch a catch 18. The pawl 18 is pivotably located by an axis 19. The catch 18 preferably possesses two protruding ratchet surfaces 20 and 21 into which a lever arm 22 of the pawl 16 can engage. There is therefore preferably two different ratchet positions; the so-called pre-ratchet position and the so-called main ratchet position.

The second control contour 15 has two indentations 24 and 25 into which the other arm 23 of the pawl 16 can reach. If the control disk 1 is pivoted in the clockwise direction, in the case of FIG. 1 the arm 23 is pivoted in an anti-clockwise direction around the axis 17. The pawl 16 can thus be lifted out of its ratchet position, preferably against the force of a pre-tensioned spring. The arm 23 then initially lies adjacent to a bracket-shaped external contour of the control contour 15 and ultimately engages into the second indentation 25 in order to ratchet the catch 18 again if necessary. If the control disk 1 is then further rotated in a clockwise direction, the pawl 16 is lifted again by rotation in an anti-clockwise direction.

The pawl 16 is preferably pre-tensioned by a non-illustrated spring in such a way that it can be moved into its ratchet position by spring force. The pawl 16 can lock or ratchet in the open and closed position and is lifted over the second control contour 15 in due course, i.e. moved out of its ratchet position.

FIG. 3 shows a third plane of the control contour 1 with a third, circular control contour 26 arranged excentrically relative to the axis 2 for controlling or pivoting of a transmission lever 27. The transmission lever 27 is pivotably located by the axis 17 and can therefore be pivoted around the axis 17. The axis 19 of the catch 18 is attached to one arm 28 of the transmission lever 27. The circular contour 26 is located within a U-typed lever arm 29 of the transmission lever 27. By pivoting of the transmission lever 27 around its axis 17 the position of the catch 18 can be lifted and lowered in order to thus change a gap between the hood and the chassis following ratcheting. Within the scope of a latching process, a gap can be ultimately minimized between the hood and the chassis by lowering. The transmission lever 27 can therefore pull the locking mechanism 16, 18 in the ratcheted state into a position with a minimized joint.

The transmission lever 27 is also pivoted by rotation of the control disk 1. If, for example, in the case of FIG. 3, the control disk is rotated in a clockwise direction, the position of the catch 18 is thus further lifted.

Overall, the transmission lever 27 is preferably approximately Y-shaped, as illustrated, in order to thus enable the desired processes with little construction space and light weight.

The gearwheel 12 is in particular rotated by a non-illustrated electromotor and gearbox around its axis 2.

With such a latching device, the construction of which was explained by FIGS. 1 to 3, a hood is advantageously opened or closed as follows.

A hood is placed on the latching device. The latch holder 6 is then located on the lower arm of the catch 18 and on the end 7 of the ejector lever 4. A joint or gap of preferably 13 to 17 mm remains, e.g. approximately 15 mm between the hood and the adjacent chassis in order to prevent injuries due to clamped fingers. The hood is now further lowered for closure using an electromotor by rotation of the control disk in an anti-clockwise direction which causes lowering of the ejector lever 8.

In this phase, the hood can be lifted again at any time as the catch 18 is not yet latched. There is therefore no risk of trapped fingers.

If the gap between the hood and the adjacent chassis is thus reduced to preferably 4 to 8 mm. e.g. to approximately 6 mm, the pawl 16 is released by the second control contour 15. The pawl 16 can now pivot into its ratchet position by spring force, for example, and latches the catch 18. The locking bolt or latch holder 6 can now no longer leave the locking mechanism. The hood can no longer be lifted. As the gap is small enough, the clamping risk no longer exists at this time.

Now, with the aid of the transmission lever 27 and the third control contour 26 the hood is closed apart from a small gap of preferably 0-2 mm.

For opening, the drive performs the actions in a reverse sequence until release of the hood. The technical implementation of the movements succeeds via the control disk 1 which guarantees the precise sequence of lever movements.

In the case of power outage, the hood can be latched manually at least in the pre-ratchet position. Mechanical opening is still possible for a workshop.

REFERENCE SIGN LIST

1: Control disk
2: Control disk axis
3: First control contour
4: Ejector lever
5: Axis for the ejector lever
6: Latch holder

7: Bent-off end of an arm of the ejector lever
8: Arm of the ejector lever
9: Arm of the ejector lever
10: Spring for the ejector lever
11: Spring arm for the ejector lever
12: Gearwheel
13: Bent-off short lever arm of the ejector lever
14: Spring leg
15: Second control contour
16: Pawl
17: Axis for the pawl
18: Catch
19: Axis for the catch
20: Ratchet surface of the catch
21: Ratchet surface of the catch
22: Ratchet arm of the pawl
23: Arm of the pawl
24: Indentation of the second control contour
25: Indentation of the second control contour
26: Third control contour
27: Transmission lever
28: Lever arm of the transmission lever
29: U-shaped lever arm of the transmission lever

The invention claimed is:

1. A latching device for a door or flap of a motor vehicle, the latching device comprising:

a locking mechanism having a catch, a pawl for latching and unlatching the catch, an ejector lever configured to lift and lower the door or flap, and a transmission lever configured to decrease a gap between the door or flap and a chassis of the motor vehicle when the door or flap is lowered to move the locking mechanism into a ratcheted state in which the pawl latches the catch;

an electrical drive; and a control disk rotatable by the electrical drive, wherein the control disk includes a first contour arranged in a first plane, a second contour arranged in a second plane, and a third contour arranged in a third plane, wherein the first plane, the second plane, and the third plane are discrete parallel planes, wherein the first contour is engageable with the ejector lever for pivoting the ejector lever in the first plane, wherein the second contour is engageable with the pawl for moving the pawl in the second plane, and wherein the third contour is arranged within the transmission lever and configured to pivot the transmission lever in the third plane.

2. The latching device according to claim 1, wherein the control disk is a gearwheel which is driven by the electrical drive.

3. The latching device according to claim 2, wherein the gearwheel is part of a gearbox.

4. The latching device according to claim 1, wherein all of the control contours are overlapping in a direction normal to a rotational axis of the control disk.

5. The latching device according to claim 4, wherein at least two of the ejector lever, transmission lever, and the pawl that are arranged in the discrete parallel planes are overlapping in the direction normal to the rotational axis of the control disk.

6. The latching device according to claim 1, wherein the first contour is triangular.

7. The latching device according to claim 1, wherein the second contour has one or two indentations.

8. The latching device according to claim 1, wherein the third contour is circular.

9. A method for closure of a hood of a motor vehicle, the method comprising:

arranging a latch holder of the hood on a latching device having a catch, a pawl movable for ratcheting and unratcheting the catch, and an ejector lever configured to lift and lower the hood, wherein the latch holder is supported on the ejector lever, lowering the hood to a position in which a gap of at least 10 mm is formed between the hood and an adjacent chassis, further lowering the hood by rotation of a control disk having a first control contour that engages the ejector lever to decrease the gap between the hood and the adjacent chassis to between 4 mm and 8 mm, releasing the pawl by further rotation of the control disk for ratcheting the catch via a second control contour of the control disk engaging the pawl for moving the pawl, and further rotating the control disk to decrease the gap to between 0 and 2 mm by causing a pivoting movement of a transmission lever using a third control contour of the control disk that engages the transmission lever, wherein the first control contour, the second control contour, and the third control contour are in different planes that are discrete to one another.

* * * * *